US006793528B2

(12) United States Patent
Lin et al.

(10) Patent No.: US 6,793,528 B2
(45) Date of Patent: Sep. 21, 2004

(54) COAXIAL CONNECTOR ASSEMBLY WITH PERMANENT COUPLING

(75) Inventors: Hsien-Chu Lin, Tu-chen (TW); Zhen-Da Hung, Tu-Chen (TW); Lung-Sheng Tai, Tu-chen (TW); Chia-Ming Kuo, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,582

(22) Filed: Dec. 26, 2002

(65) Prior Publication Data

US 2004/0110424 A1 Jun. 10, 2004

(51) Int. Cl.[7] ..... H01R 9/05
(52) U.S. Cl. ..... 439/582; 439/357; 439/63
(58) Field of Search ..... 439/582, 607–610, 439/578, 357, 350–356, 583, 584

(56) References Cited

U.S. PATENT DOCUMENTS 4,412,717 A * 11/1983 Monroe ..... 439/582
4,789,343 A * 12/1988 Dougherty et al. ..... 439/358 X
5,074,809 A 12/1991 Rousseau
5,611,707 A 3/1997 Meynier
6,036,540 A 3/2000 Beloritsky

* cited by examiner

*Primary Examiner*—Gary Paumen
(74) *Attorney, Agent, or Firm*—Wei Te Chung

(57) ABSTRACT

A coaxial connector assembly (1) includes a first connector (10) and a second connector (20) mating with each other. The first connector for being mounted on a printed circuit board includes a first shell (11). A latch (114) projects outwardly from the first shell. The second connector includes a second shell (21), a conductive contact (23), and an insulative housing (22). The second shell defines at least one side plate (214) for permanently engaging with the latch of the first connector. In such an arrangement, the first connector is capable of permanently coupling with the second connector.

13 Claims, 3 Drawing Sheets

COAXIAL CONNECTOR ASSEMBLY WITH PERMANENT COUPLING

CROSS-REFERENCE TO RELATED APPLICATION

This application is a contemporaneously filed entitled "ELECTRICAL CONNECTOR ASSEMBLY WITH PERMANENTLY COUPLING", invented by Hsien-Chu Lin et al, filed on the same date, and assigned to the same assignee of the present invention.

BACKGROUND OF THE INVENTION

1. Field of the Invention

The present invention generally relates to a coaxial connector assembly, and particularly to a radio frequency connector assembly.

2. Description of Related Art

In general, Microminiature coaxial (MCX) connectors generally act as antenna connectors to connect antennas with transmitters. A conventional MCX connector mates with a complementary connector by snap-on or screw.

U.S. Pat. No. 5,611,707 issued to Meynier on Mar. 18, 1997 discloses a conventional MCX connector comprising a first connector element which is arranged as a male plug, and a second connector element which is arranged as a female socket. The first connector element includes a conductive cylindrical body, which is hollow, a central contact ending in a pin, and an insulator interposed between the central contact and the body. The first connector element further includes an elastic socket, said socket has an annular peripheral bead. The second connector element includes a hollow cylindrical body, a central contact, and an insulator interposed between the body and the central contact. The second connector element includes a groove intended to receive, by snap-fastening, the bead of the elastic socket of the first connector element. Therefore, the first connector element can repeatedly mate with the second connector element.

According to Title 47 of Code of Federal Regulation (CFR) 15.203 and a public notice DA 00-1087 issued by Federal Communications Commission (FCC) on May 22, 2000, an intentional radiator shall be designed to ensure that no antenna other than that furnished by the responsible party shall be used with the transmitter. Typically, a manufacturer will either design a unique antenna connector or modify a commonly available connector to satisfy this requirement.

However, to a manufacturer, a unique antenna connector design may be expensive or unacceptable in the market, so a commonly available antenna connector for permanent mating will be a better way. Furthermore, the connector elements, especially the plug element, has a bulk size which occupies a great deal of surface area when it is mounted on a printed circuit board (PCB).

Hence, an improved coaxial connector assembly is desired to overcome the disadvantages of the prior art.

SUMMARY OF THE INVENTION

Accordingly, primary object of the present invention is to provide a coaxial connector assembly wherein the first connector is capable of permanently coupling with the second connector.

A second object of the present invention is to provide a coaxial connector assembly occupying small surface area when it is mounted on a PCB of an electrical device.

In order to achieve the objects set forth, a coaxial connector assembly includes a first connector and a second connector mating with each other. The first connector for being mounted on a PCB includes a first shell. A latch projects outwardly from the first shell. The second connector includes a second she, a conductive contact, and an insulative housing sandwiched between the second shell and the contact for retaining the contact. The second shell includes a main body and a cylindrical sleeve extending downwardly and perpendicularly from the main body. The sleeve defines at least one side plate for permanently engaging with the latch of the first connector. In such an arrangement, the first connector is capable of permanently coupling with the second connector.

Other objects, advantages and novel features of the invention will become More apparent from the following detailed description when taken in conjunction with the accompanying drawings.

DETAILED DESCRIPTION OF THE INVENTION

Reference will now be made in detail to the preferred embodiment of the present invention.

Figure 1:
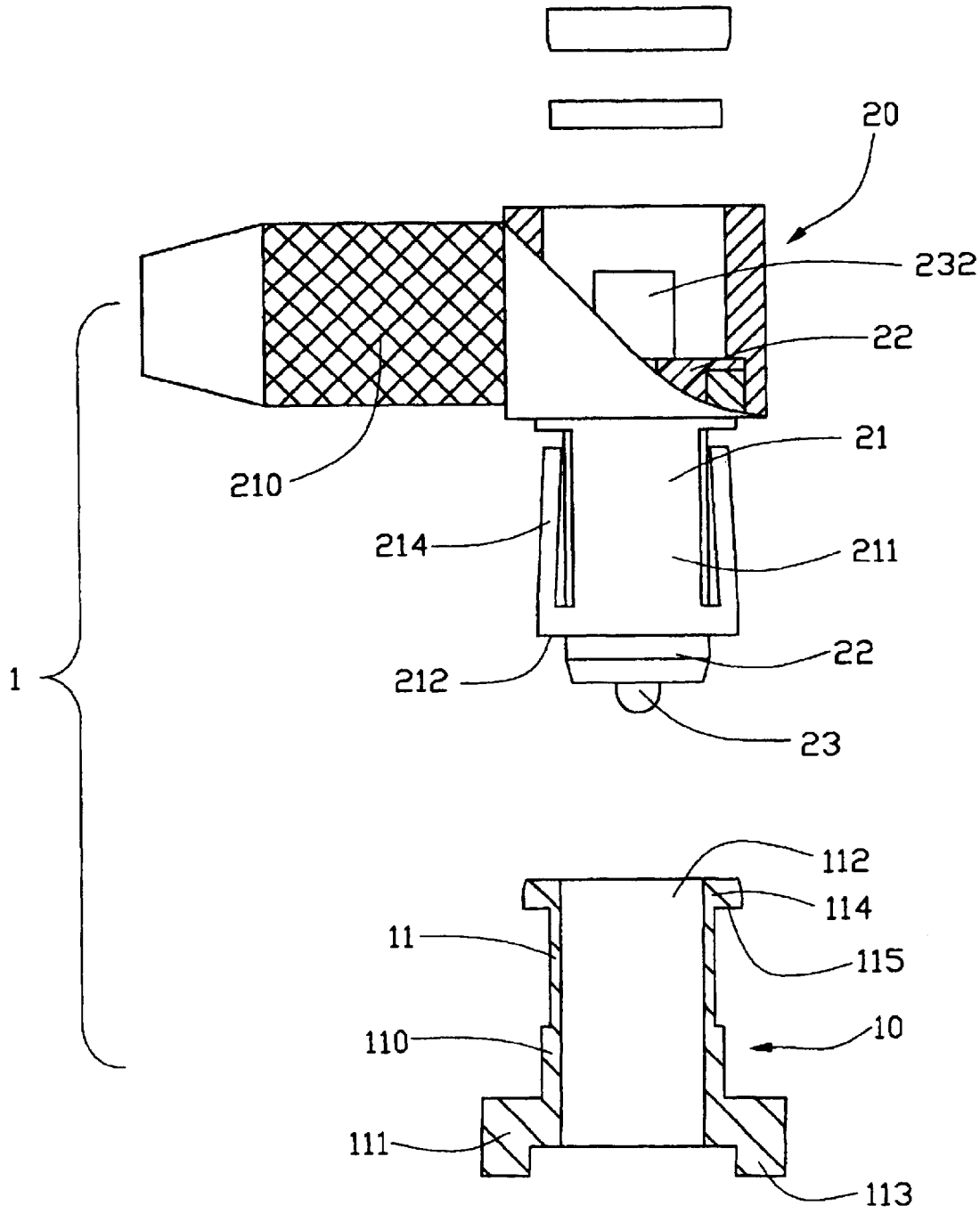
FIG. 1 is a partial cross-sectional view of a coaxial connector assembly in accordance with the present invention, wherein a first and second connectors have not been coupled together.
Figure 2:
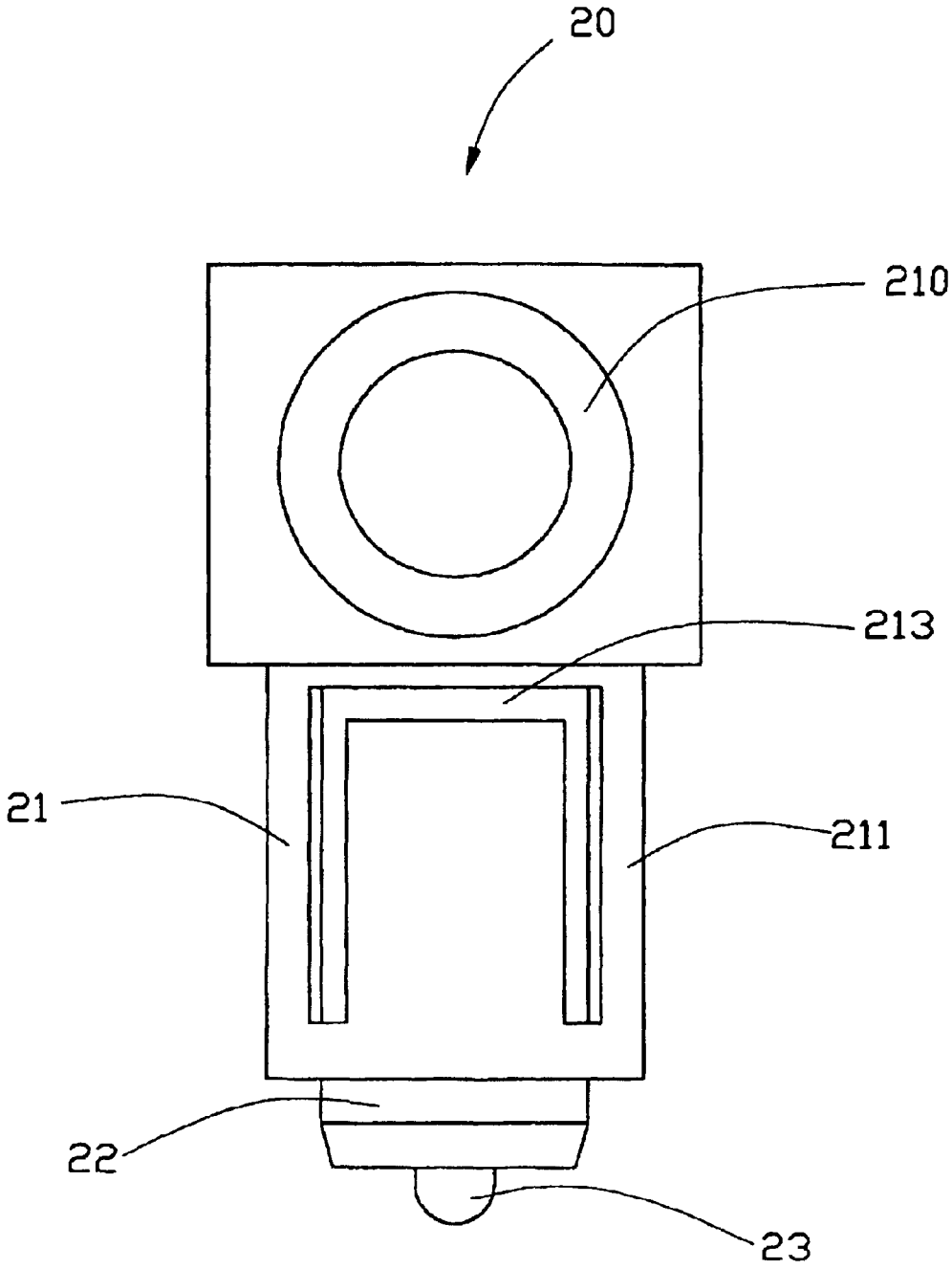
FIG. 2 is a left view of the second connector of the coaxial connector assembly of FIG. 1.
Figure 3:
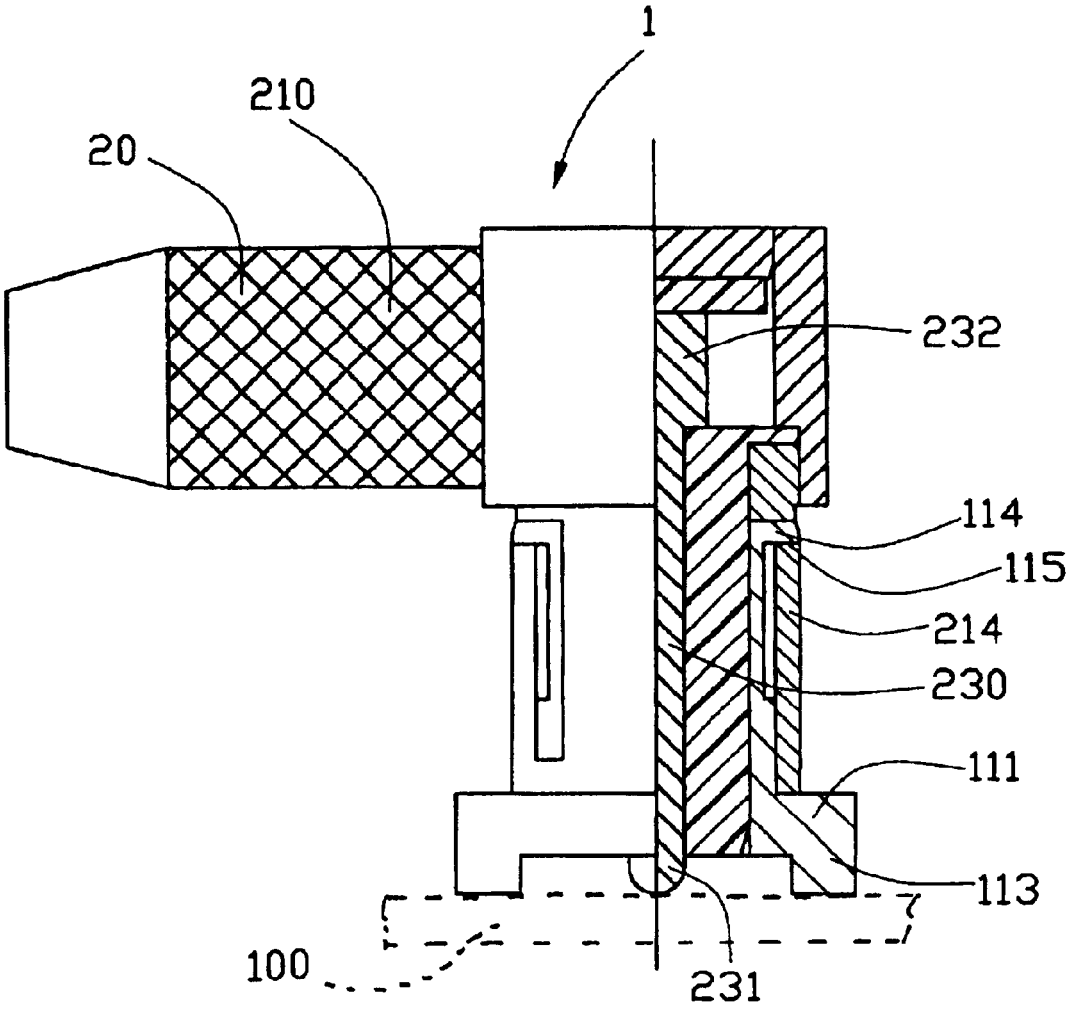
FIG. 3 is a partial cross-sectional view of the coaxial connector assembly of FIG. 1 in a coupled state.

Referring to FIGS. 1 to 3, a coaxial connector assembly 1 in accordance with the present invention comprises a first connector 10 and a second connector 20 mating with the first connector 10 for transmitting radio frequency signals therebetween. The first connector 10 includes a hollow cylindrical first shell 11. The first shell 11 defining a first receiving space 112 therein includes an engaging portion 110 and a retaining portion 111. A plurality of retaining legs 113 extend from a bottom end of the retaining portion 111. An annular latch 114 projects outwardly from the engaging portion 110 of the first shell 11. The latch 114 forms a retaining surface 115 perpendicular to a peripheral wall of the first shell 11.

The second connector 20 includes a second shell 21, a conductive contact 23 and an insulative housing 22 sandwiched between the second shell 21 and the contact 23 for retaining the contact 23. The second shell 21 includes a main body 210, and a cylindrical sleeve 211 extending downwardly and perpendicularly from the main body 210. A second receiving space 212 is defined in the sleeve 211. Two sides of the sleeve 211 symmetrically define a pair of inverted U-shaped splits 213 (FIG. 2) and symmetrically form a pair of side plates 214.

The contact 23 includes a securing portion 230 retained in the insulative housing 22, a mating portion 231 extending downwardly from a lower end of the securing portion 230 for electrically connecting to a PCB 100 of an electrical device (not shown), and a soldering portion 232 for soldered with a conductive inner core of a coaxial cable (not shown). In the present invention the second connector 20 is assembled with the coaxial cable.

In assembly, the first connector 10 is mounted on the PCB of the electrical device. The sleeve 211 of the second connector 20 is downwardly guided and assembled to the engaging portion 110 of the first connector 10. The first shell 11 is sandwiched between the second shell 21 and the insulative housing 22 and received in the second receiving space 212. The insulative housing 22 is received in the first receiving space 112. When the second connector 20 fully mates with the first connector 10, the contact 23 engages with circuit traces of the PCB thereby to establish an electrical connection therebetween. The annular latch 114 of the first connector 10 substantially locks with the side plates 214 of the second connector 20. In such an arrangement, the first connector 10 is capable of permanently locking with the second connector 20. When trying to draw out the second connector 20, the retaining surface 115 of the latch 114 of the first connector 10 locks with the side plates 214 of the second connector 20, stopping the second connector 20 being drawn out. In this state, if the second connector 20 is forcibly drawn out, the sleeve 211 will be separated from the main body 210 or the first connector 10 will be disconnected with the PCB, therefore the first connector 10 and the second connector 20 are not capable of use again. The length of each side plate 214 is far longer than the length of the latch 114 to make the first connector 10 firmly lock with the second connector 20. Furthermore, the first connector 10 occupies small surface area when it is mounted on the PCB of the electrical device, which facilitates the circuit traces design of the PCB.

It is to be understood, however, that even though numerous characteristics and advantages of the present invention have been set forth in the foregoing description, together with details of the structure and function of the invention, the disclosure is illustrative only, and changes maybe made in detail, especially in matters of shape, size, and arrangement of parts within the principles of the invention to the full extent indicated by the broad general meaning of the terms in which the appended claims are expressed.

What is claimed is:

1. A coaxial connector assembly, comprising:

a first connector, comprising:

a first shell forming a latch thereon; and a second connector, comprising:

a second shell defining at least one side plate, the at least one side plate having a free end for permanently engaging with the latch;

a conductive contact; and an insulative housing sandwiched between the second shell and the contact for retaining the contact;

wherein the length of each side plate is longer than the length of the latch;

wherein the first shell for being mounted on a PCB has an engaging portion and a securing portion extending downwardly from the engaging portion;

wherein the latch projects outwardly from the engaging portion of the first shell;

wherein the latch forms a retaining surface perpendicular to a peripheral wall of the engaging portion.

2. The coaxial connector assembly as claimed in claim 1, wherein the securing portion defines a plurality of securing legs extending downwardly from a bottom end thereof.

3. The coaxial connector assembly as claimed in claim 1, wherein the second shell has a main body and a hollow cylindrical sleeve extending downwardly from the main body for mating with the engaging portion of the first shell.

4. The coaxial connector assembly as claimed in claim 3, wherein each side of the sleeve symmetrically defines an inverted U-shaped split and symmetrically forms a pair of side plates.

5. A coaxial electrical connector, comprising:

a metallic shell including a main body and a sleeve extending from the main body, wherein the sleeve symmetrically defines a pair of inverted U-shaped splits and vertically forms a pair of straight side plates for latching with a mating connector;

a conductive contact; and an insulative housing sandwiched between the metallic shell and the conductive contact for retaining the conductive contact.

6. The electrical connector as claimed in claim 5, wherein the sleeve extends downwardly and perpendicularly from the main body.

7. An electrical connector assembly comprising:

a printed circuit board;

an upright tubular metallic shell mounted on said printed circuit board;

a retaining surface formed on said shell;

a right angle type electrical connector including a horizontal section and a vertical section extending downwardly from a distal end of said horizontal section;

said vertical section including an inner contact coaxially enclosed by an outer shield, a complementary retaining face formed on said shield; wherein the inner contact extends downwardly into and substantially throughout an interior of said shell into engagement with the printed circuit board, and the shield extends downwardly and radially overlapped with the shell under a condition of the retaining surface being latchably engaged with the complementary retaining face so as to secure the connector and the shell together.

8. The assembly as claimed in claim 7, wherein an overlapped area between the shield and the shell vertically occupies most portions of said shell.

9. The assembly as claimed in claim 7, wherein said shield surrounds said shell.

10. The assembly as claimed in claim 7, wherein said connector further includes an tubular insulative housing located between the contact and shield.

11. The assembly as claimed in claim 10, wherein said housing is received in the shell.

12. The assembly as claimed in claim 11, wherein said shell is sandwiched between said shield and said housing.

13. The assembly as claimed in claim 8, wherein the retaining surface of the shell is located at the distal end thereof and far away from the printed circuit board, and the complementary retaining face of the shield is located fair away from a distal end thereof.

* * * * *